US010137695B2

(12) United States Patent
Wagner et al.

(10) Patent No.: US 10,137,695 B2
(45) Date of Patent: Nov. 27, 2018

(54) PRINTHEAD PRIMING

(71) Applicant: HEWLETT-PACKARD DEVELOPMENT COMPANY, L.P., Houston, TX (US)

(72) Inventors: Jeffrey A Wagner, Vancouver, WA (US); Justin M Roman, Portland, OR (US); Christopher J Arnold, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/542,429

(22) PCT Filed: Jan. 30, 2015

(86) PCT No.: PCT/US2015/013914

§ 371 (c)(1),
(2) Date: Jul. 9, 2017

(87) PCT Pub. No.: WO2016/122641

PCT Pub. Date: Aug. 4, 2016

(65) Prior Publication Data

US 2017/0361618 A1 Dec. 21, 2017

(51) Int. Cl.

| | |
|---|---|
| ***B41J 2/175*** | (2006.01) |
| ***B41J 2/19*** | (2006.01) |
| ***B41J 29/38*** | (2006.01) |

(52) U.S. Cl.

CPC ..... *B41J 2/17523* (2013.01); *B41J 2/175* (2013.01); *B41J 2/17566* (2013.01); *B41J 2/19* (2013.01); *B41J 29/38* (2013.01)

(58) Field of Classification Search

CPC .... B41J 2/175; B41J 2/17596; B41J 2/17523; B41J 2/17556

See application file for complete search history.

(56) References Cited

U.S. PATENT DOCUMENTS

| | | | | |
|---|---|---|---|---|
| 4,591,874 | A * | 5/1986 | Piatt | B41J 2/175 347/78 |
| 4,806,955 | A | 2/1989 | Koto et al. | |
| 5,918,628 | A * | 7/1999 | Harding | F02C 7/232 137/497 |
| 6,036,296 | A | 3/2000 | Axtell et al. | |
| 7,257,940 | B1 * | 8/2007 | Knight | F02K 9/50 60/257 |
| 7,524,044 | B2 | 4/2009 | Kumagai | |
| 7,819,515 | B2 | 10/2010 | Silverbrook et al. | |

(Continued)

FOREIGN PATENT DOCUMENTS

| | | |
|---|---|---|
| JP | 2009189902 | 8/2009 |

OTHER PUBLICATIONS

Squid Ink Manufacturing Co. SQ/2 2 Scorpion Ink Jet Printing System. Quality, Economical Ink Jet Printing. Data Sheet.

*Primary Examiner* — John P Zimmermann
(74) *Attorney, Agent, or Firm* — Brooks Cameron & Huebsch PLLC

(57) ABSTRACT

Printhead priming can, in various examples, employ a conduit and a divider such that a predetermined portion of a pressurized gas in the conduit is provided to an environment surrounding the divider and a remaining portion of the pressurized gas in the conduit is provided to a printhead at a pressure sufficient to prime an ink supply.

15 Claims, 3 Drawing Sheets

(56) References Cited

U.S. PATENT DOCUMENTS

| | | | | |
|---|---|---|---|---|
| 8,449,089 | B2 | 5/2013 | Aruga et al. | |
| 8,814,319 | B2 | 8/2014 | Lebron et al. | |
| 9,004,627 | B2 | 4/2015 | Izawa et al. | |
| 9,643,426 | B2 | 5/2017 | Sato et al. | |
| 2007/0195144 | A1 | 8/2007 | McNestry | |
| 2009/0179932 | A1 | 7/2009 | Kumagai | |
| 2009/0303283 | A1 | 12/2009 | Nakano et al. | |
| 2010/0066773 | A1* | 3/2010 | Taga | B41J 2/175 347/6 |
| 2010/0220127 | A1 | 9/2010 | Levy et al. | |
| 2012/0056959 | A1 | 3/2012 | Smith et al. | |
| 2017/0361618 | A1 | 12/2017 | Wagner et al. | |

* cited by examiner

PRINTHEAD PRIMING

BACKGROUND

Various printers such as ink-jet printers may employ a printhead with nozzles that apply a quantity of printing fluid from the nozzles to specified pixel locations on a print medium. Such printheads may be coupled to a printing fluid supply that is primed (e.g., pressurized) in advance of printing to apply a quantity of printing fluid as intended (i.e., print as intended).

DETAILED DESCRIPTION

Figure 1:
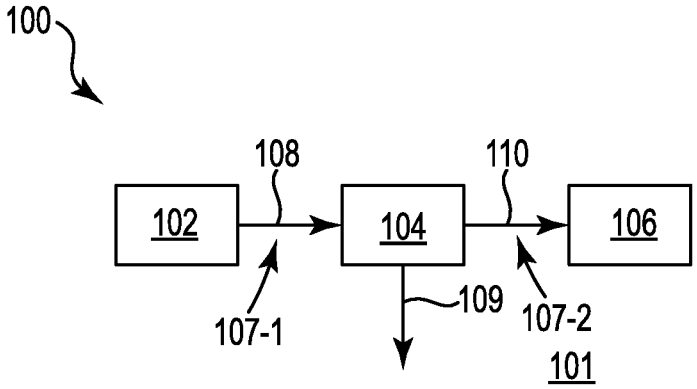
FIG. 1 illustrates a diagram of an example of a printhead priming system.

With increasing pressure on organizations to improve their performance, the organizations may seek to increase efficiencies of services and/or products provided, for instance, by pursuing improved performance (e.g., comparatively increased print quality and/or printing speed) of printers. Various printers such as ink-jet printers or three dimensional printers (e.g., three dimensional printers utilizing various ink jet components and/or those suitable to deposit of consumable fluids including powders in a layer-wise additive manufacturing process) may employ a printhead with nozzles that apply a quantity of printing fluid from the nozzles to specified pixel locations on a print medium. That is, each of the nozzles may be controlled to produce a desired pixel pattern on the print medium. However, producing the desired pixel pattern may be predicated on a printing fluid supply (i.e., an ink supply) coupled to and/or in fluidic communication with the printhead being primed (e.g., in a state ready to provide an amount of printing fluid sufficient to obtain the desired pixel pattern). Put another way, when such an ink supply is not primed in advance of printing, various difficulties including not providing a desired amount of printing fluid to the printhead may occur.

Some approaches employ a gas (e.g., air) pump to prime a printhead. In such approaches the gas pump changes an internal pressure of the printhead. For example, gas pressure pulses from a pressure source or pressure sources (e.g., such as blow-priming pumps) may serve as priming events that force a small volume of gas into regulator gas bags inside an inkjet pen. As the gas pressure pulses inflate the regulator gas bags, a small volume is displaced within the regulator chamber (ink reservoir) of an inkjet pen. Priming may occur with or without ejecting or forcing printing fluid out of the printhead. Often a controller controls pulse lengths, dwell times and a number of gas pulses from the pressure source(s) based on operating characteristics of the inkjet pen, such as the printing fluid rheology, operating temperature, and micro-fluidic architecture of the particular printhead.

However, such approaches may employ closed pumping systems that do not intentionally vent gas other than to the printhead during priming. The closed pumping systems thus may be maintained within relatively small pressure ranges to function as intended. As a result, these approaches may have relatively low tolerances when experiencing unintentional leaks of gas such as those often encountered during an operational lifetime of a printhead associated with the closed pumping system. Moreover, such approaches may rely on actions of a human and/or an electromechanical component(s) to physically alter a flow path(s) of a gas (e.g., by varying a position of an electromechanical solenoid valve or other electromechanical valve). For instance, depending upon whether the system is priming or not priming a printhead a valve in the pumping system may be shut or open, respectively, to provide varying flow paths of a gas. As a result, such approaches employing closed systems and/or active systems (e.g., relying on actions of a human and/or an electromechanical component(s) to alter a flow path of a gas) may be costly and/or ineffective, among other deficiencies.

In contrast, examples described herein include methods, systems, and computer-readable media with executable instructions stored thereon to prime a printhead. Printhead priming can, for example, employ systems including a conduit and a divider such that a predetermined portion of a pressurized gas in the conduit is provided to an environment surrounding the divider and a remaining portion of the pressurized gas in the conduit is provided to a printhead at a pressure sufficient to prime a printhead.

Printhead priming, as described herein, employs semi-open systems to prime printheads that among other things provide a predetermined portion of a pressurized gas (i.e., gas at a pressure above an environmental pressure) in a conduit to an environment (i.e., providing the predetermined portion of the pressurized gas in the conduit to the environment at a known rate). Further, printhead priming can, in various examples, utilize a pump (e.g., running a pump continuously) to compensate for the predetermined portion of a pressurized gas provided to the environment. Advantageously, impact(s) of an unintended leak(s) having comparatively small volume(s) relative to a volume of the predetermined portion of the pressurized gas provided to the environment can be negated by printhead priming, as described herein. Additional advantages such as improved reliability and ease of manufacture, among others, can be realized by employing a passive printhead priming system that does use human interaction or include electromechanical components to alter a flow path (e.g., employ electricity to change a valve position) of gas to prime a printhead. As a result, a flow path of a gas in the printhead priming systems remains constant (i.e., does not vary) regardless of whether the systems are actively priming a printhead at a given time due at least in part to an absence of electromechanical components such as those employed by other approaches to alter a flow path of gas. Put another way, in contrast to systems that employ valves to close (i.e., intentionally provide gas only to a printhead during priming), the predetermined portion of pressurized gas in a conduit is provided to the printhead is provided to the environment when priming a printhead, as described herein.

FIG. 1 illustrates a diagram of an example of a printhead priming system. The printhead priming system 100 can include a pressure source 102, a divider 104, and a printhead 106, all of which are located in an environment 101 (e.g., an ambient environment). As used herein, an ambient environment refers to an external environment having conditions such as an ambient pressure in which the methods, printhead priming systems, and/or printers as described herein are employed.

Figure 2:
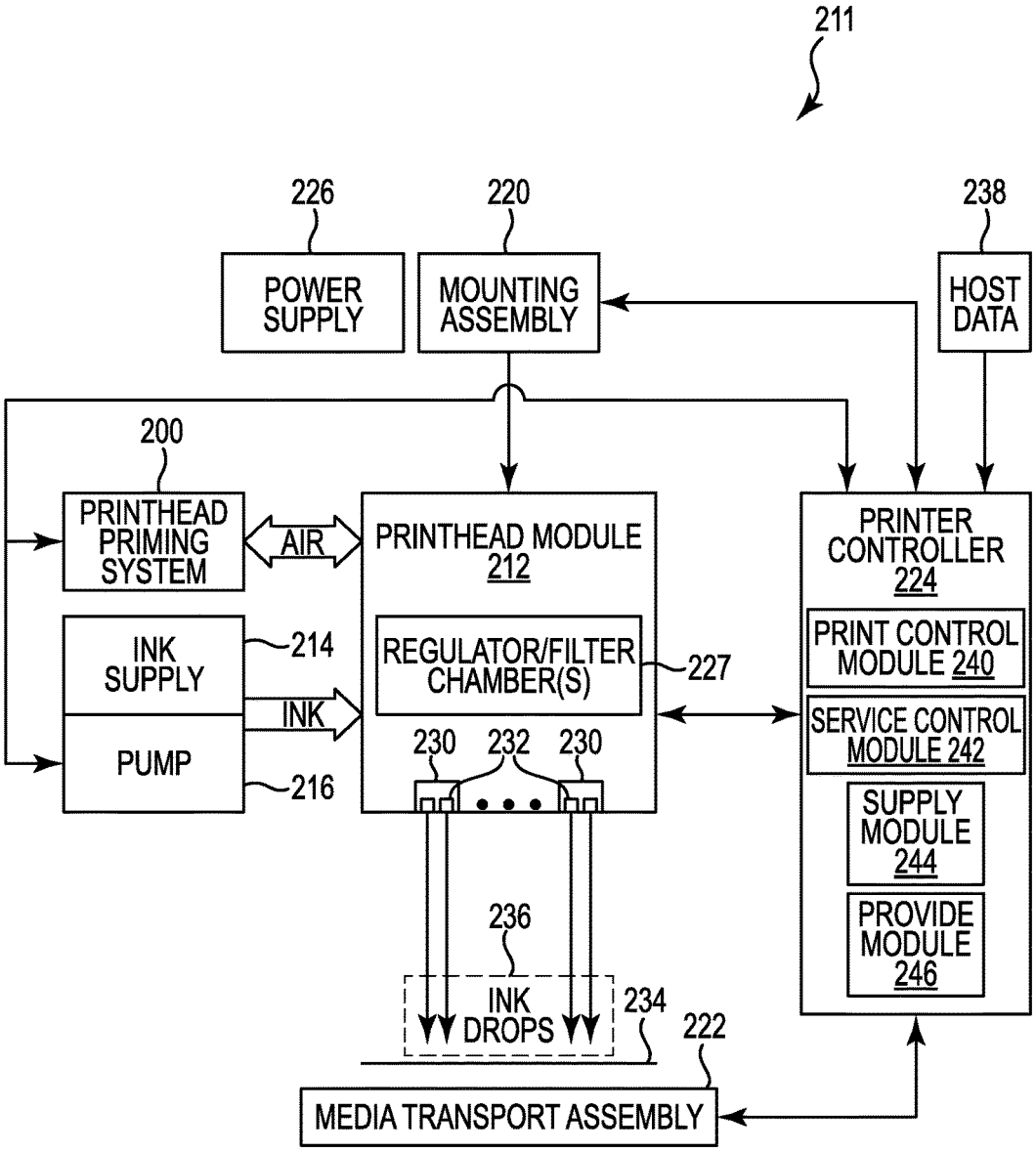
FIG. 2 illustrates a diagram of an example of a printer with an example of a printhead priming system.

The pressure source 102 provides gas (e.g., air) pulses that force small volumes of gas into regulator gas bags in regulator chambers of printhead 106. That is, the small volumes of gas inflate the regulator gas bags which displace a small volume of printing fluid in a reservoir within printhead 106. Pressure source 102 can be implemented, for example, as a blow priming pump such as is used in some inkjet printing systems. Pressure source 102 can, in some examples, also be implemented as a pump (e.g., pump 216 as illustrated in FIG. 2) to pump printing fluid from an ink supply to the printhead 106. In such an implementation, a pump would supply gas pressure pulses to regulator gas bags in regulator chambers of the printhead 106 as well as pressurized printing fluid to a printing fluid reservoir (i.e., an ink reservoir) in the printhead 106. In some examples, pressure source 102 can be a vessel or tank (e.g., an air storage tank) suitable to store gas received from a pump and/or provide the gas to a conduit 107.

The printhead priming system 100 includes a conduit 107 having an inlet (i.e., an end of the conduit 107 associated with the pressure source 102) and an outlet (i.e., an end of the conduit 107 associated with the divider 104 and/or the printhead 106). In various examples, the conduit 107 the inlet of the conduit 107 can be coupled to a pressure source such as a blow priming pump and the outlet of the conduit 107 can be coupled to a printhead 106.

As illustrated in FIG. 1, the conduit 107 can include a first section 107-1 of the conduit 107 located along a flow path before the divider 104 and a second section 107-2 of the conduit 107 located along a flow path after the divider 104. However, the conduit 107 can include any suitable number of sections to prime printheads as described herein. For instance, the conduit 107 can include a single section located along a flow path before the divider in one or more examples such as those where the divider couples the conduit 107 to the printhead 106.

Regardless of a number of sections of the conduit, the conduit 107 includes pressurized gas(es) flowing through an inner diameter of the conduit along a flow path. The flow path includes a flow of gases introduced at an inlet(s) of the conduit 107 illustrated as flow 108. Flow 108 can be divided by a divider, as described herein, into a predetermined portion of the pressurized gas illustrated as flow 109 and a remaining portion of the pressurized gas illustrated as flow 110. For example, pressurized gas(es) from the pressure source 102 can be introduced into the inlet of the conduit as flow 108 and flow along a length of the conduit 107 to the divider 104 and the printhead 106. In various examples, a total volumetric flow rate of the pressurized gas flowing through the conduit 107 at the inlet of the conduit can be divided by the divider 104 such that a predetermined portion 110 of the flow is provided to a printhead. For instance, the predetermined portion 110 of a total volumetric flow rate of the pressurized gas flowing through the conduit 107 at the inlet can be provided to the printhead 106 via an outlet of the conduit 107 while a remaining portion of the total volumetric flow rate of the pressurized gas flowing through the conduit 107 can be provided via a divider to the environment 101 as flow 109.

The predetermined portion of a pressurized gas provided to the environment can be induced by the divider 104 (i.e., an orifice(s), a valve such as a passive ball bubble valve, or a check valve (driven by a pressure gradient), and/or a gasket included in or forming the divider, among other possibilities). That is, the divider 104 divides a pressurized gas flowing through the conduit 107 such that a predetermined portion of the pressurized gas in the conduit is provided to (e.g., permitted to be provided to) an environment 101 surrounding the divider and a remaining portion of the pressurized gas in the conduit 107 is provided to the printhead 106. For instance, the remaining portion can be provided via an outlet of the conduit 107 to the printhead 106 at a pressure and/or pressures within a range sufficient to prime the printhead (i.e., cause a regulator bag of an ink supply associated with the printhead 106 to inflate).

The divider is located external to the printhead 106. For example, the divider 104 can be located at an outlet of the conduit 107 (e.g., an outlet of the conduit 107 that is coupled to or otherwise permits a portion of the pressurized gas to be provided to the printhead 106) or along the length of the conduit 107, among other possibilities to promote printhead priming as described herein. The divider 104 can be separate and distinct from the conduit 107 and/or the printhead 106 or in some examples the divider 104 can be include in or form at least a portion of the conduit 107 and/or the printhead 106. For example the divider can be a component that is separate and distinct from the conduit 107 and the printhead 106 that is capable of being coupled to the conduit 107 and/or the printhead 106. Alternatively, the divider 104 can be an integral portion (e.g., an orifice(s)) included in the conduit 107 and/or the printhead 106. In some examples, the divider 104 couples the conduit 107 to the printhead 106.

As used herein, the divider 104 is passive. That is, the divider does not use human interaction or electromechanical components (i.e., the divider is not electrically powered and does not employ electromechanical components to vary a relative position of the divider) to alter a flow path (e.g., change a valve position) of gas to prime a printhead. That is the flow path of the pressurized gas through the conduit 107 to the printhead remains unchanged whether the printhead is being actively primed or not. Thus, the divider 104 and therefore the printhead priming system 100 including the same has an improved reliability and ease of manufacture, among other advantages, as compared to other approaches that rely on human interaction and/or include electromechanical components to alter a flow path (e.g., change a valve position) of gas to prime the printhead. 106.

In some examples, the divider 104 can include an orifice to provide the predetermined portion of the pressurized gas via the orifice to the environment 101 surrounding the divider 104. However, the disclosure is not so limited. That is the divider 104 can include or can be formed from an orifice or other opening(s) operable to or otherwise suitable to provide the predetermined portion of the pressurized gas via the orifice to the environment 101 surrounding the divider 104. In one or more examples, the divider can include a pressure release valve and/or a pressure regulator with an orifice operable to provide the predetermined portion of the pressurized gas via the orifice to the environment surrounding the divider. In some examples, the divider 104 divider includes a gasket with an orifice operable to provide the predetermined portion of the pressurized gas via the orifice to the environment surrounding the divider. That is the divider 104 can include a pressure regulator, an orifice(s), a pressure release valve, and/or a gasket, among other components suitable to provide the predetermined portion of the pressurized gas via the orifice to the environment surrounding the divider 104.

A predetermined portion of the pressurized gas provided to the environment can, in some examples, be at least 1 percent of a total volumetric flow rate of the pressurized gas flowing into the conduit 107 at an inlet(s) of the conduit. Advantageously, having such a predetermined portion (i.e., at least 1 percent of the total volumetric flow rate of the pressurized gas flowing into the conduit 107) provided to the environment can effectively negate the impact of unintended leaks of the pressurized gas to the environment and thereby provide an effective operational range that is improved (i.e., accounts for unintended leaks) as compared to other approaches which employ closed pumping/priming systems.

A volumetric flow rate of gas illustrated in FIG. 1 at flow 108 can be equal to a sum of the volumetric flow rates of gas in a predetermined portion of the pressurized gas illustrated as flow 109 and a remaining portion of the pressurized gas illustrated as flow 110. In some examples, the predetermined portion of the gas provided to the environment can be 1 percent to 45 percent of a total volumetric flow rate of the pressurized gas flowing through the conduit at an inlet(s) and a remaining portion can be 55 percent to 99 percent of the total volumetric flow rate. All individual values and subranges from 1 percent to 45 percent and 55 percent to 99 percent of a total volumetric flow rate of the pressurized gas flowing through the conduit are included; for example, the predetermined portion of the gas provided to the environment can have from a lower limit of 1 percent, 10 percent, or 20 percent to an upper limit of 45 percent, 35 percent, or 25 percent of the predetermined portion of the gas provided to the environment, while the remaining portion of the total volumetric flow rate of the pressurized gas flowing through the conduit at an inlet(s) can have a lower limit of 55 percent, 65 percent, or 75 percent to an upper limit of 99 percent, 90 percent, or 80 percent of the remaining portion of the pressurized gas in the conduit provided to the printhead.

The printhead 106, as detailed with respect to FIG. 2 includes a variety of components including one or more regulator/filter chambers that contain pressure control regulators to regulate printing fluid pressure within the chambers and one or more filters to filter printing fluid and at least one fluid ejection assembly (e.g., a thermal or piezoelectric ejection assembly) in a printhead die and associated mechanical and electrical components for ejecting drops of printing fluid through a plurality of orifices or printing fluid ejection nozzles (i.e., ink ejection nozzles 232) toward print media 234 so as to print onto print media 234.

While the above described elements and configurations are illustrated in FIG. 1 and others are illustrated with respect to FIG. 2 the disclosure is not so limited. Rather, more or less components can be included in the printhead priming system and/or arranged in various configurations to promote printhead priming, as described herein. For instance, in some examples, a connector (not shown) can be included in addition to and/or as a component of the divider 104 to couple the divider 104 and/or the conduit 107 to the printhead 106 (e.g., to an ink supply of the printhead 106), among other possibilities.

FIG. 2 illustrates a diagram of an example of a printer with an example of a printhead priming system according to the disclosure. Printer 211 includes an inkjet pen or printhead module 212 (the terms "inkjet pen" and "printhead module" may be used interchangeably throughout this disclosure), an ink supply 214, a pump 216, a printhead priming system 200, mounting assembly 220, a media transport assembly 222, a printer controller 224, and at least one power supply 226 that provides power to the various electrical components of printer 211. Printhead module 212 generally includes one or more regulator/filter chambers 227 that contain pressure control regulators to regulate printing fluid pressure within the chambers 227 and one or more filters to filter ink. Printhead module 212 also includes at least one fluid ejection assembly or printhead 230 (e.g., a thermal or piezoelectric printhead 230) having a printhead die and associated mechanical and electrical components for ejecting drops of printing fluid through a plurality of orifices or ink ejection nozzles 232 toward print media 234 so as to print onto print media 234. Printhead module 212 also generally includes a carrier that carries the printhead 230, provides electrical communication between the printhead 230 and printer controller 224, and provides fluidic communication between the printhead 230 and ink supply 214 through carrier manifold passages.

Nozzles 232 are usually arranged in one or more columns such that properly sequenced ejection of printing fluid from the nozzles causes characters, symbols, and/or other graphics or images to be printed upon print media 234 as the printhead module 212 and print media 234 are moved relative to each other. A typical thermal inkjet (TIJ) printhead includes a nozzle layer arrayed with nozzles 232 and firing resistors formed on an integrated circuit chip/die positioned behind the nozzles. Each printhead 230 is operatively connected to printer controller 224 and ink supply 214. In operation, printer controller 224 selectively energizes the firing resistors to generate heat and vaporize small portions of fluid within firing chambers, forming vapor bubbles that eject drops of printing fluid through nozzles 232 on to the print media 234. In a piezoelectric (PIJ) printhead, a piezoelectric element is used to eject printing fluid from a nozzle. In operation, printer controller 224 selectively energizes the piezoelectric elements located close to the nozzles, causing them to deform very rapidly and eject printing fluid through the nozzles.

Ink supply 214 and pump 216 form part of an printing fluid delivery system (i.e., an ink delivery system (IDS)) within printer 211. In general, the IDS causes ink to flow to printheads 230 from ink supply 214 through chambers 227 in printhead module 212. In some examples the IDS may also include a vacuum pump (not shown) that together with the ink supply 214, pump 216 and printhead modules 212, form an printing fluid recirculation system between the supply 214 and printhead module 212. In a recirculating system having a vacuum pump, portions of printing fluid not consumed (i.e., printing fluid not ejected) can flow back again to the ink supply 214. In one or more examples of a recirculating system, a single pump such as pump 216 can be used to both supply and recirculate printing fluid in the IDS such that a vacuum pump may not be included. Notably, the ink supply 214 is located off-axis and provides liquid and/or powdered printing fluid to the printheads through flexible tubing extending between the ink supply and the printhead(s).

While FIG. 2 depicts the printhead priming system 200 as being included in the printer 211, the printhead priming system 200 is located external to the printer 211 and coupled by a divider and/or a connector to the printer 211. The printhead priming system 200 includes a pressure source (similar or analogous to pressure source 102 illustrated in FIG. 1) that provides gas pulses that force small volumes of gas (e.g., air) into regulator gas bags in the regulator chambers 227 of printhead module 212. As discussed in more detail below, the small volumes of gas inflate the regulator gas bags which displace a small volume in a reservoir within printhead module 212. The displacement of the volume (e.g., a volume of ink) within printhead module 212 excites the meniscus in each of the nozzles associated with the ink reservoir, but does not eject or force printing fluid out of the nozzles. Pressure source can be implemented, for example, as a blow priming pump such as is used in some printers to service printheads. Pressure source can also be implemented as a pump such as pump 216 used to pump printing fluid from the ink supply 214 to the printhead module 212. In such an implementation, a pump 216 can supply gas pressure pulses to regulator gas bags in regulator chambers 227 of printhead module 212 as well as pressurized printing fluid to an ink reservoir in printhead module 212.

Mounting assembly 220 positions printhead module 212 relative to media transport assembly 222, and media transport assembly 222 positions print media 234 relative to inkjet printhead module 212. Thus, a print zone 236 is defined adjacent to nozzles 232 in an area between printhead module 212 and print media 234. Printer 211 may include a series of printhead modules 212 that are stationary and that span the width of the print media 234, or one or more modules that scan back and forth across the width of print media 234. In a scanning type printhead assembly, mounting assembly 220 includes a moveable carriage for moving printhead module(s) 212 relative to media transport assembly 222 to scan print media 234. In a stationary or non-scanning type printhead assembly, mounting assembly 220 fixes printhead module(s) 212 at a prescribed position relative to media transport assembly 222. Thus, media transport assembly 222 positions print media 234 relative to printhead module(s) 212.

Data 238 can be sent to printer 211 along an electronic, infrared, optical, or other information transfer path. Data 238 represents, for example, a document and/or file to be printed. As such, data 238 forms a print job for printer 211 and includes one or more print job commands and/or command parameters. Printer controller 224 receives host data 238 from a host system, such as a computer, and includes memory for temporarily or otherwise storing data 238.

Printer controller 224 typically includes a processor, software, hardware, firmware, and/or logic, and other printer electronics to perform a number of functions described herein including communicating with and controlling inkjet printhead module 212, a printhead priming system 200, ink supply 214 and pump 216, mounting assembly 220, and media transport assembly 222. For example, the printer controller 224 can be a combination of hardware and instructions to prime printheads. The hardware, for example can include a processing resource and/or a memory resource (e.g., computer-readable medium (CRM), data store, etc.)

A processing resource, as used herein, can include a number of processors capable of executing instructions stored by a memory resource. Processing resource can be integrated in a single device or distributed across multiple devices (e.g., multiple servers). The instructions (e.g., computer-readable instructions (CRI)) can include instructions stored on the memory resource and executable by the processing resource to implement a desired function (e.g., supplying pressurized gas to an inlet of a conduit from a pressure source, etc.).

The memory resource can be in communication with a processing resource. A memory resource, as used herein, can include a number of memory components capable of storing instructions that can be executed by processing resource. Such memory resource can be a non-transitory CRM. Memory resource can be integrated in a single device or distributed across multiple devices. Further, memory resource can be fully or partially integrated in the same device as processing resource or it can be separate but accessible to that device and processing resource. Thus, it is noted that the print controller 224 can be implemented as part of or in conjunction with the systems and printers, as described herein.

The memory resource can be in communication with the processing resource via a communication link (e.g., path). The communication link can be local or remote to a computing device associated with the processing resource. Examples of a local communication link can include an electronic bus internal to a computing device where the memory resource is one of volatile, non-volatile, fixed, and/or removable storage medium in communication with the processing resource via the electronic bus.

The memory resource and therefore the printer controller 224 include a number of modules such as a print control module 240, a service control module 242, a supply module 244, a provide module 246, etc. The number of modules 240, 242, 244, 246 can include CRI that when executed by the processing resource can perform a number of functions. The number of modules 240, 242, 244, 246 can be sub-modules of other modules. For example, the print control module 240 and the service control module 242 can be sub-modules and/or contained within the same computing device. In another example, the number of modules 240, 242, 244, 246 can comprise individual modules at separate and distinct locations (e.g., CRM, etc.).

Each of the number of modules 240, 242, 244, 246 can include instructions that when executed by the processing resource can perform various functions including those described herein. For example, the print control module 240 includes instructions that when executed by the processing resource control inkjet printhead module 212 and printheads 230 to eject printing fluid drops from nozzles 232. Thus, printer controller 224 defines a pattern of ejected printing fluid drops which form characters, symbols, and/or other graphics or images on print media 234. The pattern of ejected printing fluid drops is determined by the print job commands and/or command parameters from data 238.

The service print control module 240 includes instructions that when executed by the processing resource control servicing of printhead module 212, for example, by controlling nozzle priming events through the operation of a printhead priming system 200 including pressure source(s). More specifically, print controller 224 executes instructions from service control module 242 to control which pressure sources are generating gas (e.g., air) pressure pulses (i.e., when there are multiple pressure sources), the timing of the pulses (e.g., with respect to printing drop ejection events), the pulse lengths, the dwell times (i.e., the time between each gas pressure pulse to deflate the regulator gas bag) and the number of pulses being generated and directed through pressure regulator vents into regulator gas bags or dedicated printing fluid priming ports within printhead module 212. Service control module 242 instructions can be specifically configured based on operating characteristics of the particular printhead module 212 in order to control the pulse lengths, dwell times and number of gas pulses in a manner that achieves printing fluid displacements within the printhead module 212 that cause disruptions of the printing fluid meniscus in nozzles without causing printing fluid to be ejected from or drool from the nozzles. Such characteristics can include, for example, rheology of the printing fluid being used in printhead module 212, the operating temperature, and micro-fluidic architecture of the particular printhead 230.

Supply module 244 includes instructions that when executed by the processing resource supply pressurized gas to an inlet of a conduit from a pressure source. Supplying can, for example, include executing instructions to cause a supply of pressurized gas to be permitted to an inlet(s) of the conduit.

Provide module 246 includes instructions that when executed by the processing resource provide, via a divider, a predetermined portion of a pressurized gas in a conduit, such as the conduit supplied pressured gas by the supply module 244, to an environment (e.g., an ambient environment) surrounding the divider and/or and provide a remaining portion of the pressurized gas in the conduit to a printhead (e.g., at a predetermined pressure sufficient to prime an ink supply of the printhead). Providing refers to an egress of the pressurized gas from the conduit to the environment and/or the printhead via the divider (i.e., the passive divider).

In one or more examples, printer 211 is a drop-on-demand thermal bubble Printer where the printhead 230 is a thermal inkjet (TIJ) printhead. The TIJ printhead implements a thermal resistor ejection element in an printing fluid chamber to vaporize printing fluid and create bubbles that force ink or other printing fluid out of a nozzle 232. In another example, printer 211 is a drop-on-demand piezoelectric printer where the printhead 230 is a piezoelectric inkjet (PIJ) printhead that implements a piezoelectric material actuator as an ejection element to generate pressure pulses that force ink or other printing fluid out of a nozzle 232.

Figure 3:
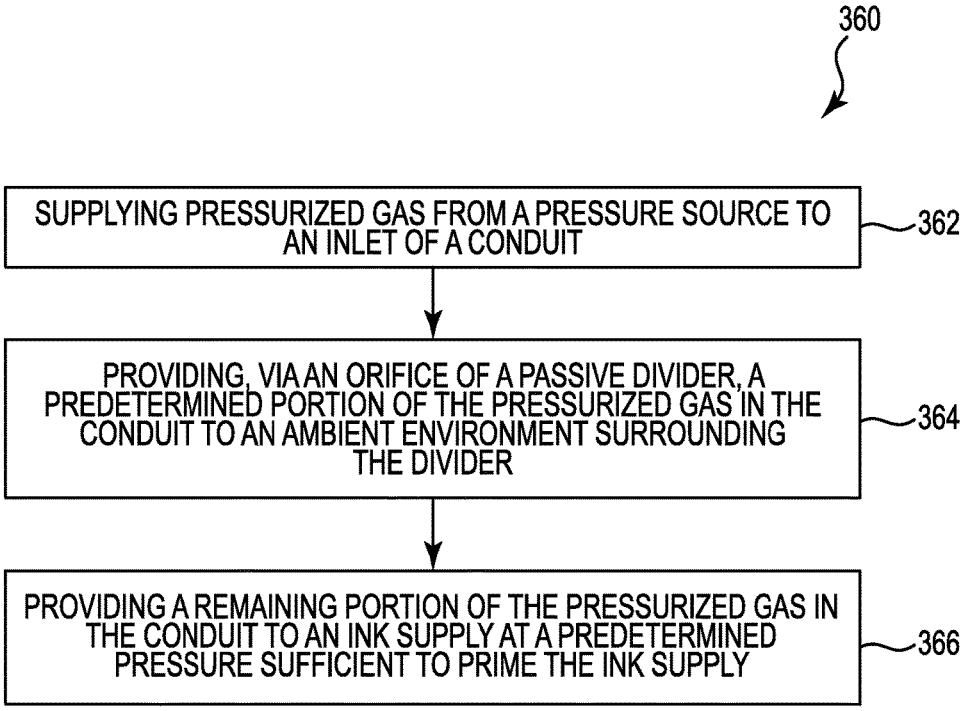
FIG. 3 illustrates a flow diagram of an example of a method to prime printheads.

FIG. 3 illustrates a flow diagram of an example of a method to prime printheads according to the disclosure. As shown at 362, in various examples, the method 360 can include supplying pressurized gas to an inlet of a conduit from a pressure source.

The method 360 can include providing, via an orifice of a divider (e.g., a divider coupling the conduit to the printhead), a predetermined portion of the pressurized gas in the conduit to an ambient environment surrounding the divider at a known rate, as shown at 364. Providing refers to causing the egress of the pressurized gas from the orifice and/or the conduit. As shown at 366, the method 360 can include providing a remaining portion of the pressurized gas in the conduit to an ink supply at a predetermined pressure sufficient to prime the ink supply, as described herein.

In some examples, the pressure source is a blow priming pump run continuously during priming of the printhead. Put another way, in such examples, the blow priming pump can be run continuously to promote providing the remaining portion to the ink supply at (equal to or above) the predetermined pressure sufficient to prime the printhead during priming of the printhead. Providing the remaining portion to prime the printhead in combination with providing the predetermined portion to the environment can provide improved reliability (enhance tolerance of unintended leaks of the pressurized gas), among other advantages.

Notably, the blow priming pump can be run continuously to account for an unintended leak of gas such as an unintended leak in the conduit and/or the divider. In this manner, impact(s) of unintended leaks can be negated. For example, an unintended leak that provides an unknown portion of the pressurized gas in the conduit to the environment at an unknown rate that is less than a known rate of pressurized gas provided to the environment by the divider can effectively be negated. Said another way, the predetermined portion provided to the environment, as described herein, can effectively dampen or negate an impact of the unknown portion of the pressurized gas provided by the unintended leak to the environment on a pressure of the remaining portion provided to the printhead. Thus, the pressure of the remaining portion provided to the printhead advantageously remains sufficient to prime the printhead. In some examples, the blow priming pump or other pressure source can be run intermittently to maintain a desired pressure in a primed printhead (i.e., a printhead that has been primed as described herein.

In the foregoing detailed description of the disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the disclosure.

The figures herein follow a numbering convention in which the first digit corresponds to the drawing figure number and the remaining digits identify an element or component in the drawing. For example, reference numeral 100 may refer to element "00" in FIG. 1 and an analogous element may be identified by reference numeral 200 in FIG. 2. Elements shown in the various figures herein can be added, exchanged, and/or eliminated so as to provide a number of additional examples of the disclosure. In addition, the proportion and the relative scale of the elements provided in the figures are intended to illustrate the examples of the disclosure, and should not be taken in a limiting sense. Further, as used herein, "a number of" an element and/or feature can refer to one or more of such elements and/or features.

It will be understood that when an element is referred to as being "on," "connected to", "coupled to", or "coupled with" another element, it can be directly on, connected, or coupled with the other element or intervening elements may be present. As used herein, "logic" is an alternative or additional processing resource to perform a particular action and/or function, etc., described herein, which includes hardware, e.g., various forms of transistor logic, application specific integrated circuits (ASICs), etc., as opposed to computer executable instructions, e.g., software firmware, etc., stored in memory and executable by a processor.

What is claimed:

1. A system, comprising:

a conduit coupled to a printhead, where the conduit includes an inlet and an outlet; and a divider that divides a pressurized gas flowing through the conduit such that a predetermined portion of a total volumetric flow rate of the pressurized gas is provided to an environment surrounding the divider and a remaining portion of the pressurized gas in the conduit is provided via the outlet of the conduit to the printhead at a predetermined pressure sufficient to prime an ink supply of the printhead.

2. The system of claim 1, where the divider couples the conduit to the printhead.

3. The system of claim 2, where the divider includes an orifice to provide the predetermined portion of the pressurized gas via the orifice to the environment surrounding the divider.

4. The system of claim 1, where the predetermined portion of the pressurized gas provided to the environment is at least 1 percent of a total volumetric flow rate of the pressurized gas flowing into the conduit at the inlet.

5. The system of claim 1, where the predetermined portion of the gas provided to the environment is 1 percent to 45 percent of a total volumetric flow rate of the pressurized gas flowing through the conduit at the inlet and the remaining portion is 55 percent to 99 percent of the total volumetric flow rate.

6. The system of claim 1, where the divider includes a pressure release valve with an orifice operable to provide the predetermined portion of the pressurized gas via the orifice to the environment surrounding the divider.

7. The system of claim 1, where the divider includes a gasket with an orifice operable to provide the predetermined portion of the pressurized gas via the orifice to the environment surrounding the divider.

8. A system, comprising:

a pump;

a conduit including an inlet and an outlet, where the inlet is coupled to the pump; and a divider that couples the conduit to a printhead and divides pressurized gas flowing from the pump through the conduit to the printhead such that a predetermined portion of a total volumetric flow rate of the pressurized gas in the conduit is provided to an environment surrounding the divider and a remaining portion of the pressurized gas in the conduit is provided via the outlet of the conduit to the printhead at a predetermined pressure sufficient to prime an ink supply of the printhead.

9. The system of claim 8, where the divider is passive.

10. The system of claim 8, where the divider is located external to the printhead.

11. The system of claim 8, where the predetermined pressure of the remaining portion is sufficient to inflate a gas bag included in the ink supply to cause printing fluid to be supplied to the printhead.

12. A method to prime a printhead, comprising supplying pressurized gas from a pressure source to an inlet of a conduit;

providing, via an orifice of a passive divider, a predetermined portion of a total volumetric flow rate of the pressurized gas in the conduit to an ambient environment surrounding the divider; and providing a remaining portion of the pressurized gas in the conduit to an ink supply at a predetermined pressure sufficient to prime the ink supply.

13. The method of claim 12, where the pressure source is a blow priming pump run continuously to provide the remaining portion of the pressurized gas to the ink supply at the predetermined pressure.

14. The method of claim 13, where the blow priming pump is run continuously during priming to account for an unintended leak, where the unintended leak includes an unintended leak in at least one of the conduit and the divider.

15. The method of claim 14, where the unintended leak provides a portion of the pressurized gas to the environment at an unknown rate that is less than a known rate of the predetermined portion of the pressurized gas provided to the environment by the divider.

* * * * *